United States Patent [19]

Palmer

[11] Patent Number: 4,913,735

[45] Date of Patent: Apr. 3, 1990

[54] FLUX INJECTOR LANCE FOR USE IN PROCESSING ALUMINUM AND METHOD

[75] Inventor: John S. Palmer, Springfield, Ohio

[73] Assignee: Palmer Manufacturing & Supply, Inc., Springfield, Ohio

[21] Appl. No.: 308,828

[22] Filed: Feb. 9, 1989

[51] Int. Cl.[4] ..... C22B 21/00

[52] U.S. Cl. ..... 75/683; 266/225; 266/270

[58] Field of Search ..... 75/68 R, 93 E; 266/225, 266/226, 270

[56] References Cited

U.S. PATENT DOCUMENTS

| | | |
|---|---|---|
| 3,170,017 | 2/1965 | Grace . |
| 3,198,436 | 8/1965 | Kurzinski et al. . |
| 3,239,205 | 3/1966 | Metz . |
| 3,281,136 | 10/1966 | Metz . |
| 3,310,238 | 3/1967 | Bryant et al. . |
| 3,321,139 | 5/1967 | De Saint Martin . |
| 3,322,348 | 5/1967 | Vonnemann . |
| 3,338,570 | 8/1967 | Zimmer . |
| 3,379,428 | 4/1968 | Dortenzo et al. . |
| 3,387,838 | 6/1968 | Dortenzo et al. . |
| 3,559,974 | 2/1971 | Berry . |
| 3,638,932 | 2/1972 | Masella et al. . |
| 3,722,814 | 3/1973 | Miyashita . |
| 3,722,821 | 3/1973 | Jaeger et al. . |
| 3,751,019 | 8/1973 | Phillips . |
| 3,833,209 | 9/1974 | Chang . |
| 3,876,190 | 4/1975 | Johnstone et al. . |
| 4,216,908 | 8/1980 | Sakurai et al. . |
| 4,266,116 | 5/1981 | Bauer et al. . |
| 4,416,421 | 11/1983 | Browning . |
| 4,564,143 | 1/1986 | Touze . |
| 4,736,693 | 4/1988 | Clomburg, Jr. . |
| 4,779,847 | 10/1988 | Rodway . |

FOREIGN PATENT DOCUMENTS

| | | | |
|---|---|---|---|
| 2834829 | 3/1979 | Fed. Rep. of Germany | 266/225 |
| 2173582 | 10/1986 | United Kingdom | 266/225 |

*Primary Examiner*—Melvyn J. Andrews

*Attorney, Agent, or Firm*—Harness, Dickey & Pierce

[57] ABSTRACT

A lance and method for injecting particulate matter into molten metal is disclosed. The lance includes an injector conduit for introducing particulate matter into a molten metal. A heat removal site surrounds at least a portion of the injector conduit. An insulating sleeve surrounds at least a portion of the heat removal site to minimize heat transfer from molten metal. The lance is placed in molten metal and a coolant gas is circulated through the heat removal site while particulate matter is injected into the molten metal.

19 Claims, 3 Drawing Sheets

FLUX INJECTOR LANCE FOR USE IN PROCESSING ALUMINUM AND METHOD

BACKGROUND AND SUMMARY OF THE INVENTION

The present invention relates generally to equipment for treating molten metals. More particularly, the invention relates to an injection lance for fluxing molten aluminum alloys.

Molten aluminum alloys, unless treated, tend to contain in solution a certain amount of undesirable impurities, such as oxides and/or gases. It is thus desirable to treat molten aluminum alloys to reduce the amounts of undesirable impurities. In general, fluxes can be added to molten aluminum alloys to chemically and mechanically react with undesirable impurities and thereby facilitate removal of the impurities. The addition of fluxes to aluminum alloy melts is known in the art and is described generally in Metals Handbook (8th Ed.), Vol. 5, p 395–397, which is hereby expressly incorporated by reference.

One popular technique for introducing flux into a molten aluminum alloy is to sprinkle flux onto the surface of the molten metal. The flux is then folded into the melt by an operator using an instrument such as a stirring paddle. This method, however, is limited in that it requires large amounts of physical labor for stirring. Further, in many instances, greater amounts of flux than normal may be needed to overcome problems associated with the stirring action, such as an increased introduction of undesirable gases into the melt.

Another popular technique for introducing flux into an aluminum alloy melt is to suspend a powdered flux in a carrier gas and to project the flux-gas suspension into the molten aluminum alloy using a conduit or lance. Typically, a lance employed in this technique has an open discharge orifice which is placed beneath the surface of the molten aluminum alloy. Further, the lance is equipped so that the gas-flux mixture is introduced into the melt under pressure. The combination of gas pressure and flux composition of the flux permits a chemical-mechanical reaction to occur between the impurities and the flux. The chemical-mechanical reaction, in turn, generally results in causing undesirable impurities to rise to the surface of the molten aluminum alloy where they can be removed by methods such as skimming methods.

A troublesome problem with the latter flux injection technology has been that inside portions of the lance tend to become clogged or plugged during normal use, thereby requiring frequent and time-consuming cleaning. In some instances, the plugging becomes so severe that the lance requires complete replacement. It is not uncommon for a flux injection lance to become clogged to an unworkable level in only a four to ten minute time frame. Thus, after approximately every four to ten minutes of lance operation, an operator must stop the injection process, wait for it to cool to a suitable handling temperature and clean the lance. In severe cases, the operator must further replace the clogged lance with a new one.

I have identified the cause of this problem as being largely due to premature melting of the flux material before being discharged from the lance. In many instances where the flux material is particulate matter, the outer surfaces of the flux particles melt and fuse with nearby particles to form an aggregation of flux particles.

The aggregation of flux particles then tends to adhere to inside walls of the lance. After a period of time, the aggregation of flux particles grows so as to cause a flux buildup on the lance walls. The flux buildup, in turn, tends to constrict passages of the lance, such as the discharge orifice and thereby restricts further passage of flux therethrough.

The fluxes popularly used in molten aluminum alloy treatment typically include admixtures of various materials, including suitable salts, which generally have a melting point significantly lower than that of aluminum. For instance, many suitable flux salts typically have a melting point of roughly 300°–800° Fahrenheit or less. The molten aluminum alloy being treated with such salts is typically maintained at a temperature of about 1300° Fahrenheit or higher. In the flux injection process, it is desired to project the suspended flux particles through the lance and into the molten aluminum, via the discharge orifice, before the flux salt particles have a chance to heat up and melt. Thus, it is preferable to prevent the flux from melting until after it is discharged from the lance and is within the molten aluminum alloy.

Using conventional lances, this is frequently a problem. Conventional lances used in molten aluminum alloy treatment typically comprise a cylinder of graphite or silicon carbide with a thinwall steel tubing insert through which the flux is conveyed. During the course of treatment, the cylinder heats up by direct contact with the molten metal. This heat is then transferred directly to the thinwall steel tubing and causes the temperature within the tubing to rise above the melting point of the flux. As a consequence, the flux that is suspended in the tubing melts, and then adheres to the inside wall of the cylinder as described above. Thus, flux buildup occurs, and often times completely plugs up the cylinder, so that time consuming and expensive cleaning is required.

The present invention overcomes various problems found in prior art aluminum alloy treatment flux injection methods by providing an improved and relatively easy-to-operate lance having a discharge orifice in which a flux injector conduit is provided with a gaseous coolant circulation system which envelops at least a portion of the conduit. The gaseous coolant circulation system permits air, or other gaseous heat removal medium, to thermally contact the conduit, defining a heat removal site about the conduit. At least a portion of the heat removal site is thermally insulated from the molten aluminum, resulting in the temperature at the discharge orifice, and along the conduit, remaining below the fusion point or melting point of the flux. In this way, melting and adhesion of the flux to the conduit along the conduit and at the discharge orifice is minimized.

In accordance with the inventive method, a powdered flux is mixed with a moving or pressurized injection carrier gas to form an injection gas-flux suspension. The lance is placed in the molten aluminum with the discharge orifice submersed in the aluminum. The injection gas-flux suspension is flowed through the lance and into the molten aluminum through the discharge orifice and the lance is cooled along the conduit and at its discharge end by passing a cooling gas adjacent to the conduit and discharge orifice. The cooling gas is provided to a chamber on the lance adjacent the conduit and discharge orifice, which chamber is sealed from the molten aluminum. In addition, heat transfer is minimized between the chamber and the molten aluminum by insulating the exterior of the chamber. In this fashion, the temperature along the conduit and at the discharge orifice is maintained below the melting point of the flux to thereby minimize adhesion of the flux to the inside walls of the conduit.

For a more complete understanding of the invention, its objects and advantages, reference may be had to the following specification and to the accompanying drawings.

BRIEF DESCRIPTION OF THE DRAWINGS

FIG. 3 is a longitudinal elevational view of a lance in accordance with the invention;

FIG. 7 is a cross-sectional view of the lance of FIG. 6 taken substantially along the line 7—7 of FIG. 6.

DESCRIPTION OF THE PREFERRED EMBODIMENTS

Figure 1:
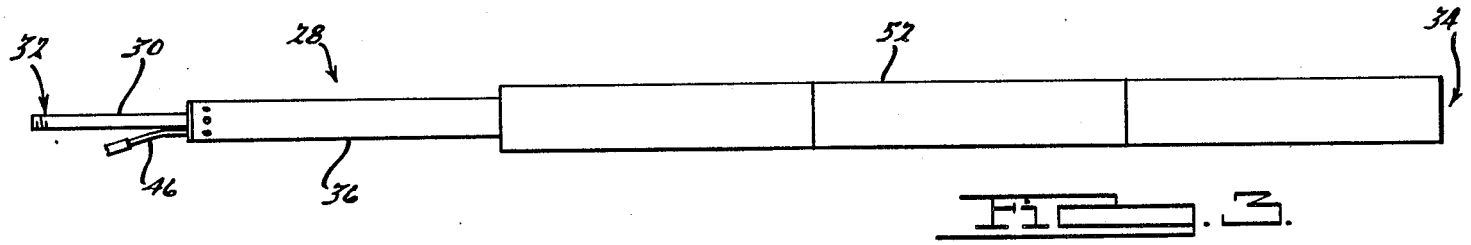
FIG. 1 is a diagrammatic system view of the flux injection equipment useful in understanding the inventive apparatus and method.

Referring first to FIG. 1, an overall system for treating a molten aluminum alloy with flux will be described. The molten aluminum alloy is contained in a refractory vessel 10, the molten aluminum alloy being designated generally as 12. During the flux treatment process, a suitable powdered flux is contained in a hopper 14 and is admixed with an injector carrier gas 16 in a mixing chamber 18. Preferably, the injector carrier gas is a substantially inert gas so as to minimize potentially undesirable chemical reactions between the molten aluminum alloy and the injector carrier gas. The flux becomes suspended in the carrier gas and is flowed through an outlet 20 to a lance 22 via a connecting hose 24. In the present embodiment, for processing about a one-ton melt of aluminum alloy for about ten minutes, it is preferred that the injector carrier gas and flux is admixed and flowed through the connecting hose at a rate of about 6 to about 20 ounces of flux per minute, and more preferably about 10 to about 14 ounces of flux per minute. One skilled in the art will appreciate that such rate varies in a generally direct proportion with the amount of molten aluminum alloy, and also depends on factors such the type of flux employed.

As will be further described in detail below, lance 22 is cooled by a suitable cooling gas so that the injected flux is generally maintained a temperature below its melting point while still within the lance. Preferably the cooling gas is supplied by an air compressor 26, or by another suitable source of pressurized air or other suitable gaseous coolant. Ultimately, the flux is injected into the molten aluminum alloy where it contacts and combines with impurities and other unwanted oxides and gases in solution, and forms compounds which can be skimmed off, thereby generating a higher purity aluminum alloy.

Figure 2:
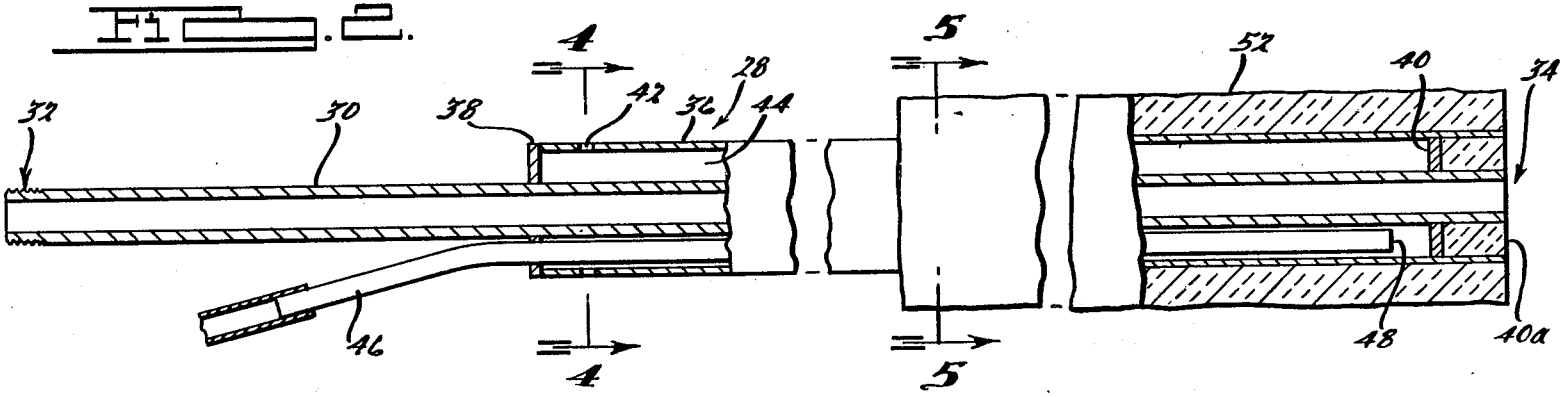
FIG. 2 is a longitudinal cross-sectional view of a first embodiment of a lance in accordance with the invention.

Referring now to FIG. 2, a first embodiment of the lance is illustrated generally as 28. The lance comprises a flux injector conduit 30 which may be fabricated from pipe having an inner diameter suitable for flowing particulate matter therethrough. Preferably, conduit 30 is made from ⅜ inch inner diameter black pipe. The flux injector conduit 30 is preferably fabricated from a suitable steel or an alternative material having a melting point greater than aluminum. In the present preferred embodiment, conduit 30 is about four and a half feet long. Conduit 30 is suitably threaded at end 32 for attaching to hose 24 (shown in FIG. 1). The opposite end 34 is open to define a discharge orifice through which the suspended flux passes into the molten aluminum alloy during use.

It should be noted that the operating parameters and dimensions set forth in the present embodiment are chosen to provide a relatively easy-to-operate lance. The operating parameters and dimensions of the lance, however, may be susceptible to slight modification to take into account factors such as the individual handling needs of the operator.

Lance 28 is provided with a jacket 36 which is generally concentrically arranged to envelop the conduit adjacent the discharge orifice (at end 34). Jacket 36 is preferably fabricated from approximately one and a half inch outer diameter thinwall tubing and extends from the discharge orifice end 34 to beyond the midsection of conduit 30. In the present preferred embodiment the jacket 36 is about four feet long. The tubing of the jacket 36 is preferably a steel material or an alternative material having a melting point greater than aluminum.

Both ends of jacket 36 are sealed to the exterior of conduit 30 using suitable end plugs 38 and 40. Preferably end plugs 38 and 40 are steel washers which are welded to the exterior of the conduit and the jacket 36. Also, disposed adjacent to end plug 40 is a refractory plug **40*a* which is preferably made of a suitable cast refractory material. Jacket 36 is provided with a plurality of vent holes 42 in a region adjacent to end plug 38. Preferably the vent holes are about one-eighth inch in diameter and are spaced peripherally about the jacket 36 at approximately equal distance from each other. In the present preferred embodiment there are eight vent holes. Otherwise, jacket 36 defines a sealed chamber which envelops conduit 30 to define a cooling chamber 44. Cooling chamber 44** has a predetermined volume to assure adequate heat removal therefrom. In the present preferred embodiment the cooling chamber has a volume of about 70 to about 110 cubic inches.

Entering through end plug 38 is a coolant feed tube 46 which extends substantially parallel to conduit 30 and terminates with an open end 48 adjacent but spaced apart from end plug 40. Preferably the coolant feed tube is made from one quarter inch steel tubing and terminates with the open end spaced about one half inch from end plug 40. In use, coolant gas, such as compressed air, is fed through the coolant feed tube 46 at a predetermined flow rate sufficient to cause cooling of the chamber to a temperature less than about the melting point of the flux. The coolant gas is allowed to circulate in cooling chamber 44, and exit through the vent holes 42. In the present embodiment the preferred flow rate for the coolant gas is about 200 to about 300 SCFH. In use, these vent holes 42 are disposed above the surface of the molten aluminum. The space within cooling chamber 44, bounded by the outer wall of conduit 30, defines a heat removal site where heat is extracted by the circulating air or other gaseous coolant and discharged through vent holes 42.

In order to ensure that the circulating air does not become heated excessively by the proximity to the molten aluminum in which the lance is immersed, a thermal insulator 52 is provided. Preferably, thermal insulator 52 is in the form of a plurality of insulating sleeves disposed in series along the jacket 36. As shown in FIG. 3, in the present preferred embodiment, there are three insulating sleeves, each one being about a foot long and having an outer diameter of approximately two and a half inches, and an inner diameter of approximately one and a half inches. Preferably the composition of the insulating sleeves include alumina-silicate fibers in a starch binder, or the equivalent. As illustrated in FIG. 3, the thermal insulator extends approximately one-half to two-thirds the length of jacket 36. It should be appreciated that depending on a variation in one or more of the operating parameters described herein, the thickness of insulation material also may be varied to achieve a suitable amount of insulation for the lance. For a more complete understanding of the manner in which this first preferred embodiment is constructed, reference may be had to the cross sectional views of FIGS. 4 and 5, which bear reference numerals corresponding to those of FIG. 2.

Figure 1:
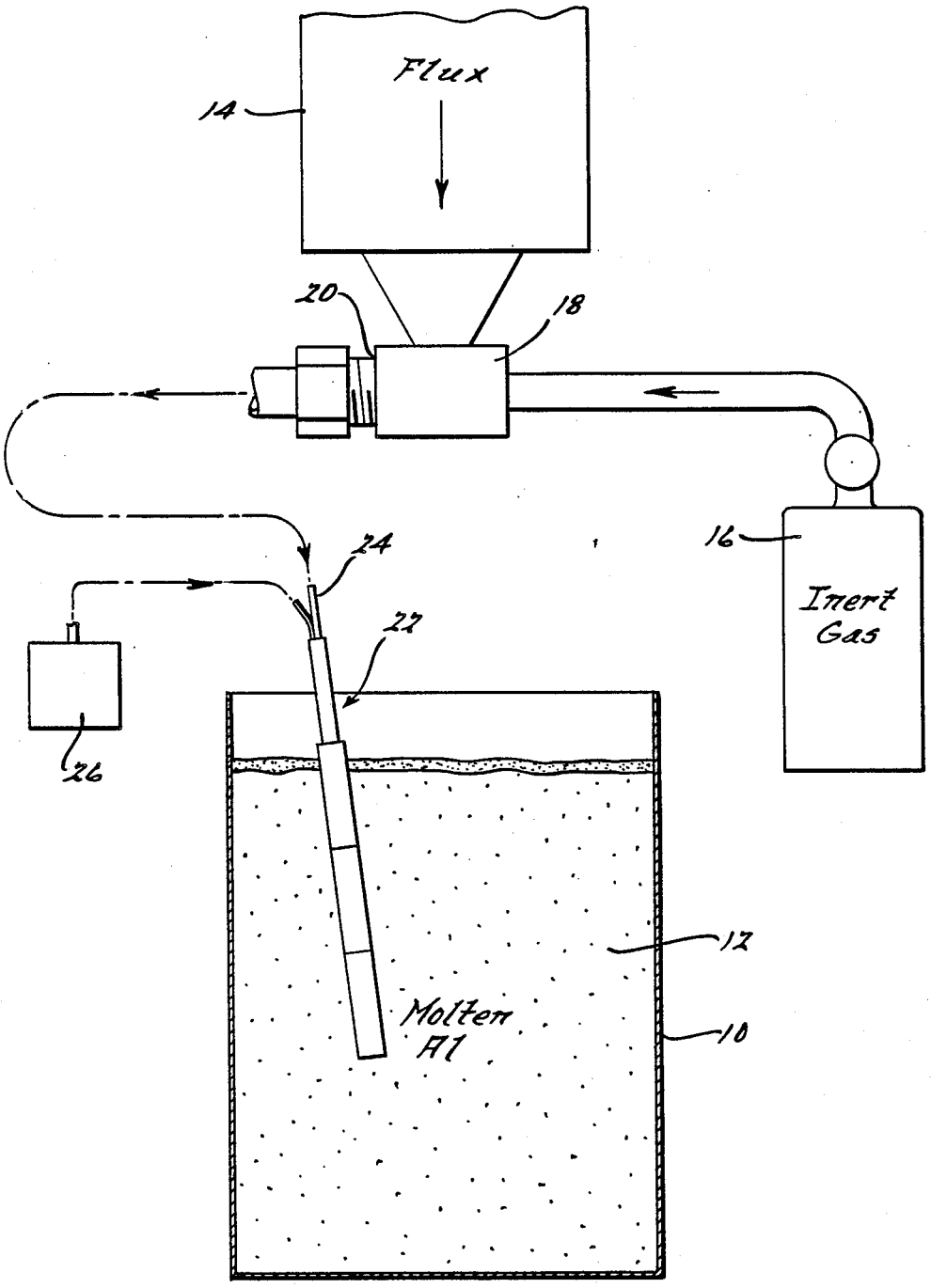
Figures 1, 4, 5, 6:
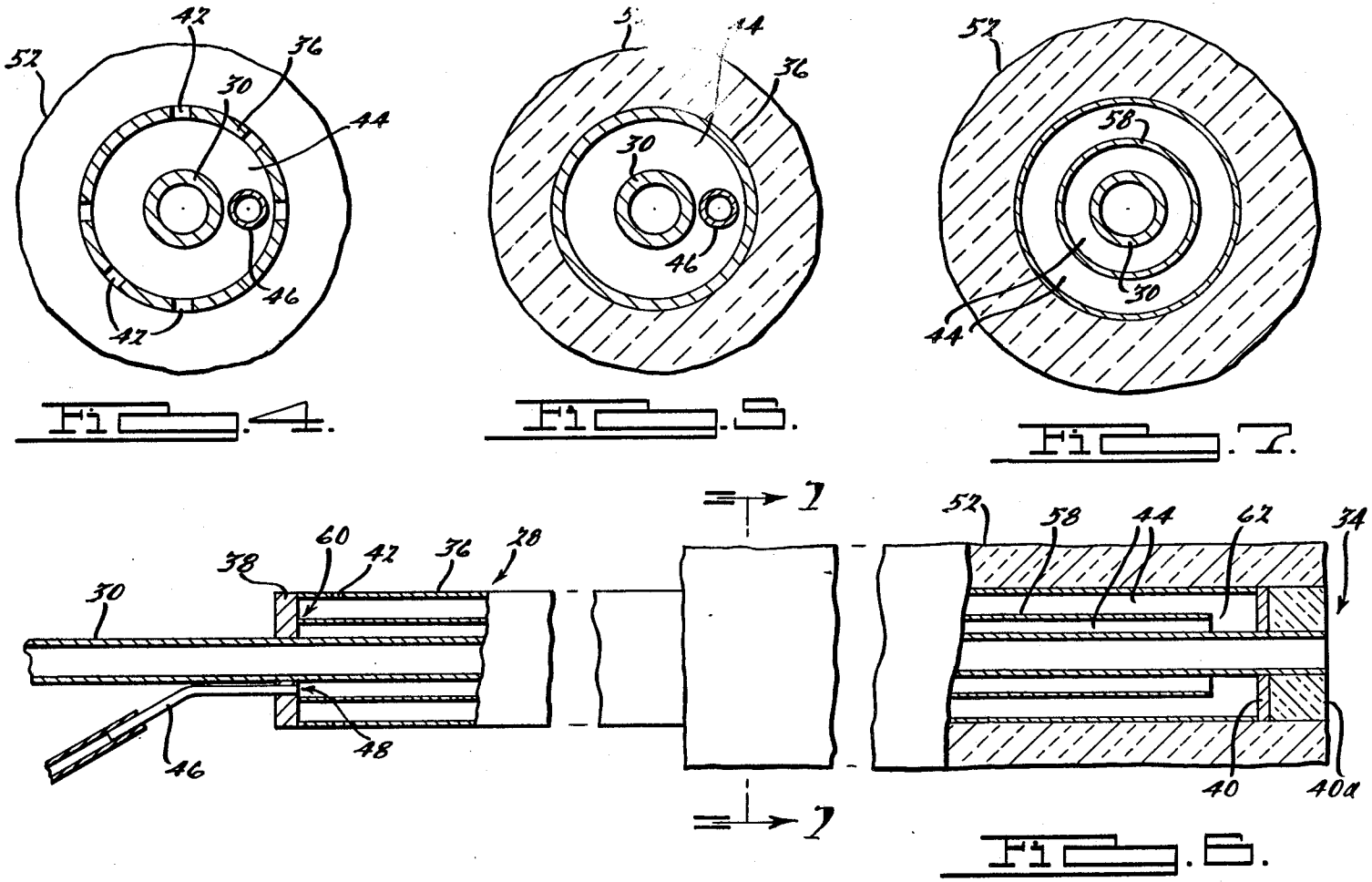
FIG. 4 is a cross-sectional view of the lance of FIG. 2 taken substantially along the line 4—4 in FIG. 2.
FIG. 5 is a cross-sectional view of the lance of FIG. 2 taken substantially along the line 5—5 of FIG. 2.
FIG. 6 is a longitudinal cross-sectional view of a second embodiment of lance in accordance with the invention.

A second embodiment of the invention is illustrated in FIGS. 6 and 7. This embodiment is similar to that of FIGS. 2–5, except that the cooling chamber comprises a multiple chamber folded construction, and more preferably, a dual-chamber folded construction. Specifically, with reference to FIGS. 6 and 7, jacket 36 is attached to conduit 30 using end plugs 38 and 40 as previously described. Disposed within jacket 36 is an inner cylindrical baffle 58 which is generally concentric with and within conduit 30 and jacket 36 and is disposed with a first end 60 abutting and sealing with end plug 38. The opposite end 62 of baffle 58 is open and spaced apart from end plug 40. Coolant feed tube 46 enters through end plug 38 so that its open end 48 communicates with the interior of cylindrical baffle 58. The open end 62 in turn communicates with the interior of jacket 36, thereby defining cooling chamber 44 which is preferably a serpentine or back folded path by which the gaseous coolant is circulated. As with the first embodiment, this second embodiment is also provided with a thermal insulator 52.

While this invention has been disclosed in connection with the introduction of flux into a molten aluminum alloy, one skilled in the art will appreciate that the apparatus and methods are susceptible to modification for a number of additional uses. For instance, it is possible to use the present apparatus and methods to introduce particulate matter to a molten metal in applications where it is preferred that the particulate matter be introduced at a temperature significantly below that of the molten metal. For instance, relatively low melting point alloying elements may be introduced into a molten metal using the present apparatus and methods.

As discussed above, an objective of the invention is to maintain the lance temperature along the conduit 30 and at the discharge orifice region below the melting point of the flux, in order to prevent clogging. The amount of flux normally required to treat a melt of aluminum alloy is determined by multiplying the quantity of metal to be treated by an empirically determined factor of 0.003. The result of this multiplication yields the total amount of flux needed to treat the molten metal bath effectively. This product, is then divided by the number of treatment minutes to give the amount of flux per minute necessary.

For example, to treat a 1000 pound bath of aluminum, about 3 pounds of flux are required. This means that for a normal treatment cycle of eight minutes, about 6 ounces of flux per minute would be necessary. Prior to my invention, the amount of time a metal bath could be treated was limited by the amount of flux that could be delivered through the existing lance without clogging. The largest quantity of molten metal could be that treated in conventional fashion rarely exceeded more than 1500 pounds. With my improved lance, clogging has been all but eliminated, with a significant increase in the amount of metal that can be treated at one time.

The following example may be studied for a further understanding of my invention and its performance capabilities. Specifically, Table I gives the specifications of a lance device in accordance with the present invention. Table II shows the temperature adjacent the discharge orifice at various time intervals measured from the time the lance is first inserted into the molten aluminum bath. As seen, even after ten minutes, the lance temperature is well below the melting point (which ranges from approximately 300–800 degrees) of the flux, notwithstanding the fact that the molten bath into which the lance is immersed is at 1300 degrees Fahrenheit or higher.

EXAMPLE

About a ton of type 380 aluminum alloy is melted. A lance as shown in FIG. 2, but having approximately the dimensions set forth in Table I is employed to inject about 10–14 ounces of flux per minute into the aluminum alloy melt. Flux is injected for about 10 minutes. The flux is suspended in a carrier gas having a flow rate of about 60 SCFH. The flow rate of cooling gas is about 200 SCFH. The temperature of the inside of the lance is taken at one minute intervals and is shown in Table II. The initial temperature of the aluminum alloy melt is about 1310 F.

After about 10 minutes the temperature of the aluminum alloy melt is about 1302° F.

TABLE I

| LANCE PART | DIMENSIONS |
|---|---|
| JACKET | 4 Feet Long; 1½ Inch Outer Diameter Thin Wall Tubing |
| INSULATING SLEEVE | Three One Foot Long Sections, Each Section Having a 1½ Inch Inner Diameter and 2½ Inch Outer Diameter |
| CONDUIT | 4½ Feet Long; ⅜ Inch Inner Diameter |
| VENT HOLES | 8 Holes; ⅛ Inch Diameter Each |
| COOLANT FEED TUBE | ¼ Inch Outer Diameter; 3/16 Inner Diameter |

TABLE II

| TIME | APPROXIMATE INNER LANCE TEMPERATURE |
|---|---|
| 0 MIN | 56° F. |
| 1 MIN | 114° F. |
| 2 MIN | 149° F. |
| 3 MIN | 159° F. |
| 4 MIN | 175° F. |
| 5 MIN | 190° F. |
| 6 MIN | 205° F. |
| 7 MIN | 220° F. |
| 8 MIN | 236° F. |
| 9 MIN | 250° F. |

TABLE II-continued

| TIME | APPROXIMATE INNER LANCE TEMPERATURE |
|---|---|
| 10 MIN | 266° F. |

While the invention has been described in connection with its presently preferred embodiments, it will be understood that the invention is capable of certain modification without departing from the spirit of the invention as set forth in the appended claims.

What is claimed is:

1. A lance for introducing particulate matter into a molten metal, comprising:

(a) an injector conduit having a longitudinal axis, a first end for coupling to a source of particulate matter, and a second end with an opening therein for introducing said particulate matter into a molten metal;

(b) means surrounding at least a portion of said conduit for circulating a gaseous coolant about said injector conduit to thereby define a heat removal site about said injector conduit, said circulating means including a coolant feed tube having a longitudinal axis that is offset from said longitudinal axis of said injector conduit, for introducing said gaseous coolant into said heat removal site in a region near said second end of said injector conduit at a flow rate sufficient to promote cooling in said region; and (c) means for insulating said heat removal site from heat transferred from said molten metal.

2. The lance according to claim 1 wherein said injector conduit has a first end for coupling to a source of flux, and a second end with an opening therein for introducing said flux into a molten metal.

3. The lance according to claim 1 wherein said circulating means (b) is adaptable for circulating compressed air.

4. The lance according to claim 1 further comprising means coupled to said injector conduit for providing particulate matter to said injector conduit via a gas-particulate matter suspension.

5. The injector according to claim 1 wherein said insulating means (c) includes a plurality of insulating sleeves.

6. The injector according to claim 1 wherein said circulating means (b) includes a chamber having a back-folded path by which gaseous coolant is circulated.

7. A lance for introducing flux into a molten aluminum alloy, comprising:

(a) conduit means, having a longitudinal axis, a first and second end, for introducing flux into a molten aluminum alloy;

(b) a jacket enveloping at least a portion of said conduit means and sealed to the exterior of said conduit means using first and second end plugs to define a cooling chamber, said jacket having a plurality of vent holes in a region adjacent to said first end plug;

(c) means connected to said lance for supplying a cooling gas to said cooling chamber, said supplying means including a coolant feed tube having a longitudinal axis that is offset from said longitudinal axis of said conduit means for introducing said cooling gas to said cooling chamber in a region near said second end of said conduit means at a flow rate sufficient to promote cooling in said region; and (d) insulating means surrounding at least a portion of said jacket for insulating said cooling chamber from heat transferred from said molten aluminum alloy, whereby when said lance is placed in molten aluminum alloy, and a coolant gas is circulated in said cooling chamber, heat is removed from said chamber through said vent holes so that said conduit means is maintained at a temperature below the melting point of said flux.

8. The lance according to claim 7 wherein said injector further comprises an inner baffle disposed concentric with and within said conduit means and said jacket, and is disposed with a first end abutting and sealing with said first end plug, and said opposite end of said baffle is open and spaced apart from said second end plug to define a cooling chamber with a dual chamber folded construction.

9. The lance according to claim 7 further comprising a refractory plug adjacent to said second end plug.

10. The lance according to claim 7 wherein said insulating means include a plurality of insulating sleeves disposed in series along said jacket.

11. The lance according to claim 10 wherein said insulating sleeves extends approximately one-half to two-thirds the length of said jacket.

12. The lance according to claim 7 further comprising means, connected to said conduit means, for mixing flux with an injector carrier gas.

13. The lance according to claim 7 further comprising a discharge orifice defined by said second end of said conduit means, said second end plug welded about said conduit means, a refractory plug adjacent to said second end plug, and an end of said jacket adjacent to said refractory plug.

14. A method of injecting flux into a molten aluminum alloy, said method comprising the steps of:

(a) admixing a flux with a pressurized injection gas to form an injection gas-flux suspension;

(b) placing a lance, having an injector conduit with a longitudinal axis and a discharge opening, in said molten aluminum alloy to submerse said discharge opening in said molten aluminum alloy;

(c) flowing said injection gas-flux suspension through said injector conduit and into said molten aluminum alloy through said injector conduit;

(d) cooling said injector conduit and said discharge opening by introducing a cooling gas through a coolant feed tube having a longitudinal axis that is offset from said longitudinal axis of said injector conduit into said lance in a region near said discharge opening at a flow rate sufficient to promote cooling said region, and flowing said cooling gas through a chamber at least partially enveloping said injector conduit and said discharge opening, said chamber on said lance being sealed from said molten aluminum alloy; and (e) minimizing heat transfer to said chamber from said molten aluminum alloy by insulating the exterior of said chamber, whereby the temperature within said injector conduit is maintained below the melting point of said flux to thereby minimize adhesion of said flux to the inside wall of said injector conduit.

15. The method of claim 14 wherein said lance is placed in molten aluminum alloy that weighs about 2000 pounds.

16. The method of claim 14 wherein said injection gas-flux suspension is flowed through a injector conduit having an inside diameter of about $\frac{3}{8}$ inches.

17. The method of claim 15 wherein said injection gas in said gas-flux suspension is flowed through said conduit so as to flow flux therethrough at a rate of about 6 ounces per minute to about 20 ounces per minute.

18. The method of claim 15 wherein said cooling gas is flowed through a cooling chamber having a volume of about 70 to about 110 cubic inches.

19. The method of claim 15 wherein said cooling gas is flowed through said chamber at a rate of about 200 SCFH to about 300 SCFH.

* * * * *